US008743162B2

(12) United States Patent
De Paepe

(10) Patent No.: US 8,743,162 B2
(45) Date of Patent: Jun. 3, 2014

(54) EVALUATING TEMPORAL RESPONSE OF A DISPLAY

(75) Inventor: Lode René Eleonora De Paepe, Ghent (BE)

(73) Assignee: Barco N.V., Kortrijk (BE)

( * ) Notice: Subject to any disclaimer, the term of this patent is extended or adjusted under 35 U.S.C. 154(b) by 176 days.

(21) Appl. No.: 13/495,169

(22) Filed: Jun. 13, 2012

(65) Prior Publication Data

US 2013/0335382 A1 Dec. 19, 2013

(51) Int. Cl.
*G09G 5/10* (2006.01)

(52) U.S. Cl.
USPC ..... 345/691; 345/905

(58) Field of Classification Search
USPC ..... 345/904, 691, 204; 348/180; 324/760.01
See application file for complete search history.

(56) References Cited

U.S. PATENT DOCUMENTS 5,537,145 A * 7/1996 Miseli ..... 345/904
6,657,712 B2 12/2003 Yamaguchi
6,700,627 B2 3/2004 Yang et al.
6,859,192 B1 * 2/2005 Ogawa ..... 345/691
2005/0125179 A1 6/2005 Selby et al.
2010/0061694 A1 3/2010 Lee
2010/0259553 A9 10/2010 Van Belle
2011/0157261 A1 * 6/2011 Harada et al. ..... 345/691

FOREIGN PATENT DOCUMENTS

WO 2010/092130 A3 8/2010

* cited by examiner

*Primary Examiner* — Kevin M Nguyen
(74) *Attorney, Agent, or Firm* — Renner, Otto, Boisselle & Sklar, LLP

(57) ABSTRACT

Improved evaluation of temporal response of a display is achieved by displaying a plurality of test patterns. The number of pixels of each test pattern driven at the first driving level is greater than the number of pixels driven at the second driving level. In addition, each pixel is driven at a first driving level in multiple consecutive test patterns (e.g., for multiple consecutive frames) such that the actual output of the pixel when driven at the first driving level matches the uncompensated "ideal" output of that pixel when driven at the first driving level. In other words, the output of the pixel driven at the first driving level would be same as the output of that pixel after having been driven at the first luminance for a time period exceeding the maximum fall time of the pixel. The pixel is then driven at the second driving level.

25 Claims, 4 Drawing Sheets

EVALUATING TEMPORAL RESPONSE OF A DISPLAY

FIELD OF THE INVENTION

The present invention relates generally to image display devices, and particularly to methods and systems for evaluating the temporal response of image display devices.

BACKGROUND

The response time of a display is typically described as the time it takes for the luminance to go from its start value to 90% of the targeted value. Displays that are inherently slow, for example an LCD display, often utilize compensation techniques to assure the aimed pixel luminance is reached within a certain time limit. For example, one such technique includes overdriving the pixels to make sure the compensation is sufficient in all situations, but such compensation may cause undesirable effects, such as flicker and/or inconsistent edge brightness. Certain types of displays, such as those used for medical diagnosis, may have more stringent requirements. For example, in tomography it is common to scroll quickly through an image collection in what is known as a cine loop. In such instances, it may be desirable to update the display image as quickly as possible in order to preserve image quality. Image compensation, such as that described in Barco patent application WO2010092130 to Kimpe et al., may be used to adjust for temporal response limitations of displays.

In addition, the US Food and Drug Administration requires that, for displays used for medical diagnostic purposes, compensation is to be performed continuously throughout the display lifetime, and the effectiveness of the compensation must be demonstrable throughout the lifetime of the display. Demonstrating the effectiveness of image compensation typically requires testing the display in its end location.

It would be preferable if there were a system and/or method that enabled easy assessment of temporal response of a display.

SUMMARY OF THE INVENTION

There is provided a system and method for evaluating the temporal response of a display by displaying a plurality of test patterns. When evaluating rise time, each pixel is driven at a lower driving level in multiple consecutive test patterns (e.g., for multiple consecutive frames) such that the actual output of the pixel when driven at the lower driving level matches the uncompensated "ideal" output of that pixel when driven at the lower driving level. In other words, the output of the pixel driven at the lower driving level would be same as the output of that pixel after having been driven at the lower luminance for a time period exceeding the maximum fall time of the pixel.

When evaluating fall time, each pixel is driven at a higher driving level in multiple consecutive test patterns (e.g., for multiple consecutive frames) such that the actual output of the pixel when driven at the higher driving level matches the uncompensated "ideal" output of that pixel when driven at the higher driving level. In other words, the output of the pixel driven at the higher driving level would be same as the output of that pixel after having been driven at the higher driving level for a time period exceeding the maximum rise time of the pixel.

Accordingly, there is provided a method for evaluating temporal response of a display. The method includes displaying a first pattern wherein pixels of a test region of the display are driven at driving levels L1 or L2, displaying a second pattern wherein the pixels of the test region are driven at driving levels L1 or L2, wherein the second pattern is different than the first pattern; and displaying a third pattern wherein the pixels of the test region are driven at driving levels L1 or L2, wherein the third pattern is different than the first pattern. The pixels of the test region that are driven at driving level L1 in one of the first pattern, the second pattern, or the third pattern are subsequently driven at driving level L2 for the next n number of patterns, where n is greater than or equal to 2. In addition, temporal response compensation is performed for a compensation portion of the pixels of the test region and no temporal response compensation is performed for a noncompensation portion of the pixels of the test region such that a comparison can be made between the compensation portion of the pixels and the noncompensation portion of the pixels.

According to another aspect, there is provided a system for evaluating temporal response of a display. The system may include computer readable code on a non-transitory computer readable medium, wherein execution of program instructions generated by the computer readable code by at least one controller communicably coupled to the display causes the at least one controller to carry out the steps of: causing the display to display a first pattern wherein pixels of a test region of the display are driven at driving levels L1 or L2; causing the display to display a second pattern wherein the pixels of the test region are driven at driving levels L1 or L2, wherein the second pattern is different than the first pattern; and causing the display to display a third pattern wherein the pixels of the test region are driven at driving levels L1 or L2, wherein the third pattern is different than the first pattern. The pixels of the test region that are driven at driving level L1 in one of the first pattern, the second pattern, or the third pattern may be subsequently driven at driving level L2 for the next n number of patterns, where n is greater than or equal to 2. In addition, temporal response compensation may be performed for a compensation portion of the pixels of the test region and no temporal response compensation may be performed for a noncompensation portion of the pixels of the test region such that a comparison can be made between the compensation portion of the pixels and the noncompensation portion of the pixels.

According to another aspect, there is provided a display system with improved temporal compensation evaluation capabilities. The display system may include: a display; a controller communicably coupled to the display; and non-transitory memory communicably coupled to the controller, the memory comprising computer readable code, wherein execution of program instructions generated by the computer readable code by the controller causes the at least one controller to carry out the steps of: causing the display to display a first pattern wherein pixels of a test region of the display are driven at driving levels L1 or L2; causing the display to display a second pattern wherein the pixels of the test region are driven at driving levels L1 or L2, wherein the second pattern is different than the first pattern; and causing the display to display a third pattern wherein the pixels of the test region are driven at driving levels L1 or L2, wherein the third pattern is different than the first pattern. The pixels of the test region that are driven at driving level L1 in one of the first pattern, the second pattern, or the third pattern may be subsequently driven at driving level L2 for the next n number of patterns, where n is greater than or equal to 2. In addition, temporal response compensation may be performed for a compensation portion of the pixels of the test region and no temporal response compensation is performed for a noncompensation portion of the pixels of the test region such that a comparison can be made between the compensation portion of the pixels and the noncompensation portion of the pixels.

According to one aspect, the second pattern and the third pattern may be the same.

According to one aspect, for each of the first pattern, the second pattern and the third pattern, at least approximately twice as many of the pixels are driven at L2 as are driven at L1.

According to one aspect, rise time may be evaluated by defining driving level L1 to result in a higher luminance than driving level L2.

According to one aspect, fall time may be evaluated by defining driving level L2 to result in a higher luminance than driving level L1.

According to one aspect, temporal response compensation may be performed simultaneously with the display of the first pattern, the second pattern and the third pattern.

According to one aspect, the method may further include displaying a gradient feature having a plurality of regions adjacent the test region for each of the first pattern, the second pattern and the third pattern. In addition, at least some of the regions of the gradient feature may include pixels driven at intermediate driving levels between driving level L1 and driving level L2.

According to one aspect, for each of the first pattern, the second pattern and the third pattern, each pixel driven at driving level L1 may be immediately adjacent at least one pixel driven at driving level L2. In addition, for each of the first pattern, the second pattern and the third pattern, each pixel driven at driving level L1 and not adjacent the edge of the display may be immediately adjacent at least six pixels driven at driving level L2.

According to one aspect, the refresh rate of the display divided by (n number of patterns plus 1) may be greater than or equal to about 16 Hz.

According to one aspect, the refresh rate of the display divided by (n number of patterns plus 1) may be less than 20 Hz.

According to one aspect, the at least one controller may be further configured to display a gradient feature having a plurality of regions adjacent the test region for each of the first pattern, the second pattern and the third pattern. In addition, at least some of the regions of the gradient feature may include pixels driven at intermediate levels between driving level L1 and driving level L2.

According to one aspect, for each of the first pattern, the second pattern and the third pattern, each pixel driven at driving level L1 may be immediately adjacent at least one pixel driven at driving level L2. In addition, for each of the first pattern, the second pattern and the third pattern, each pixel driven at driving level L1 and not adjacent the edge of the display may be immediately adjacent at least six pixels driven at driving level L2.

The features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope.

Features that are described and/or illustrated with respect to one embodiment may be used in the same way or in a similar way in one or more other embodiments and/or in combination with or instead of the features of the other embodiments.

DETAILED DESCRIPTION

Figure 1A:
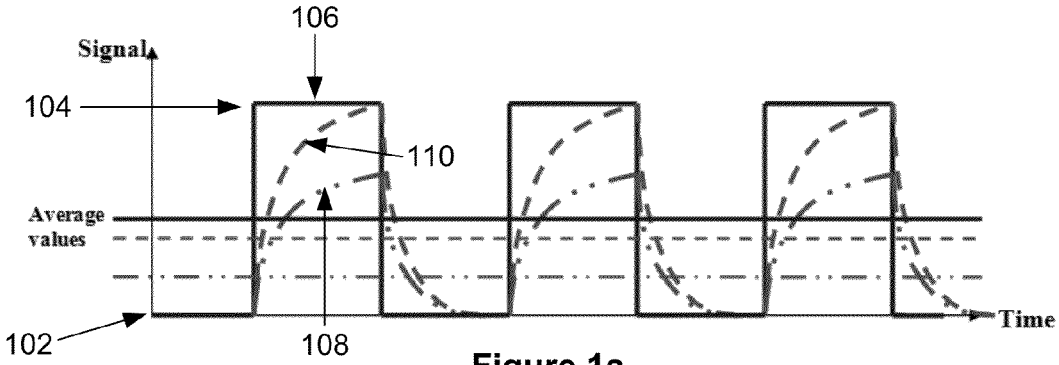
FIGS. 1*a-c* illustrate exemplary ideal, uncompensated, and compensated temporal responses of a display.

There are various methods for assessing temporal response of a display. For example, one can manually measure the trailing edge of a moving object directly on the display. Also, one can investigate the luminance of the display using an external sensor, such as by submitting a test image to the display and for various display settings comparing the output luminance with a reference value. For example, U.S. App. No. 20100061694 to Lee describes the use of such a methodology for performing gamma correction. In addition, measured luminance may be used to populate a look-up table, which is then used to obtain overdrive compensation. Such a method is described in U.S. App. No. 20050125179 to Selby et al.

Such methodologies are not, however, suitable for examining the effect of temporal compensation. One method of characterizing temporal response includes creating a set of images that are submitted to the display with the refresh rate. The average output luminance can then be compared to a static image, i.e. when only one image is submitted (this image often representing a saturated brightness of the display). For example, a method where a temporally varying pattern is used to characterize a display (for gamma compensation) is described in U.S. Pat. No. 6,700,627 to Yang et al. The described method, however, is frequency dependent because it requires the refresh rate to stay above the sensitivity of the eye (around 20 Hz) to avoid beat (i.e., flicker). In addition, the method requires varying luminance to be displayed over groups of pixels forming areas large enough to avoid artifacts due to spatial interference. Accordingly, the disclosed methodology does not enable assessment of temporal response of individual pixels.

The present invention relates to a system and method for evaluating the temporal response and/or temporal compensation of a display. More specifically, the present invention relates to a system and method for evaluating the compensated and uncompensated temporal response of a display by displaying a plurality of test patterns in a manner that enables assessment of temporal response of individual pixels. Each test pattern includes pixels driven at a lower driving level and pixels driven at a higher driving level. As the test patterns change, the driving level at which a given pixel is driven changes between the lower driving level and the higher driving level. When evaluating rise time, for example, a pixel is driven at a lower driving level in multiple consecutive test patterns (e.g., for multiple consecutive frames) such that the actual output of the pixel when driven at the lower driving level matches the uncompensated "ideal" output of that pixel when driven at the lower driving level. In other words, the output of the pixel driven at the lower driving level would be same as the output of that pixel after having been driven at the lower driving level for a time period exceeding the maximum fall time of the pixel. Once the pixel reaches the uncompensated "ideal" output for the lower driving level, it is driven at the higher driving level for a single frame. The actual output of the pixel driven at the higher driving level for a single frame is indicative of the temporal response of the pixel. If temporal compensation is active, the actual output of the pixel driven at the higher driving level may also be indicative of the efficacy of the temporal response compensation.

Figure 1B:
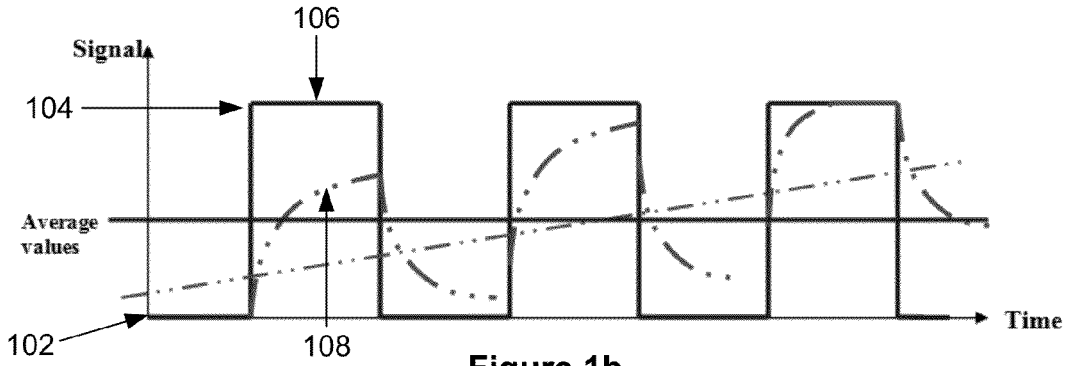
Figure 2:
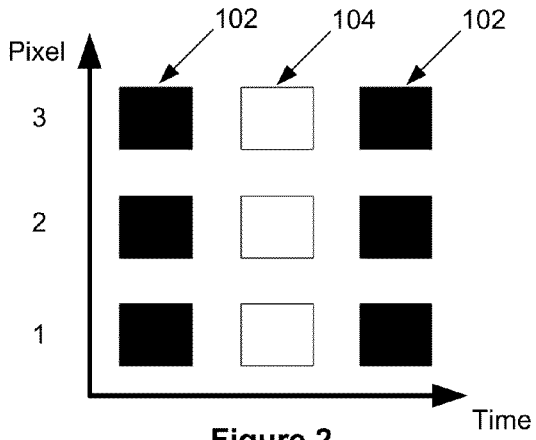
FIG. 2 illustrates a basic test pattern corresponding to FIGS. 1*a-b;*

Turning first to FIGS. 1*a-b* and FIG. 2, FIGS. 1*a-b* are temporal response graphs of a display alternating between driven at a lower driving level 102 and at an upper driving level 104, and FIG. 2 illustrates a subset of pixels driven as shown in FIGS. 1*a-b*. FIG. 1*a* illustrates an ideal display response 106, temporally uncompensated display response 108, and temporally compensated display response 110 when a pixel (or a plurality of pixels) are driven in an alternating pattern between a lower driving level 102 and an upper driving level 104 in consecutive frames. As will be understood by those of ordinary skill in the art, with respect to FIGS. 1*a-b*, the lower driving level 102 represents the ideal output of the display when driven at a lower driving level (which would typically be represented as different units) and the upper driving level 104 represents the ideal output of the display when driven at an upper driving level (which would typically be represented as different units). As shown, the fall time of the compensated display response 108 and the uncompensated display response 110 are less than the time for which each frame is displayed. In other words, each frame is displayed for a time exceeding the time required for the display to adjust to the change from being driven at the higher driving level 104 to the lower driving level 102. Accordingly, at the time the display changes between being driven at the lower driving level 102 and the upper driving level 104, the ideal display response 106, temporally uncompensated display response 108, and temporally compensated display response 110 are the same.

As the frequency of a display increases, the time period for which each frame is displayed decreases, but the rise and fall times may not change. If the actual temporal response (compensated or uncompensated) of the pixel does not reach the level of the ideal response 106 at the end of the period during which the pixel is driven at the upper driving level 104, the average luminance of the pixel would be lower than the ideal average, as is shown in FIG. 1*a*. If the actual temporal response (compensated or uncompensated) of the pixel does not reach the level of the ideal response 106 at the end of the period during which the pixel is driven at the lower driving level 102, the average luminance of the pixel would be higher than the ideal average. If the rise and fall time of the pixel are almost equal the average luminance of the pixel could alternate above and below the ideal average, which could result in a visible flicker.

In addition, if the rise time and fall time are not equal, the average luminance of the pixel will shift over time. For example, FIG. 1*b* illustrates such an effect, which exists, for example, when the actual display response (such as the uncompensated display response 108) of a pixel driven at a first driving level, such as upper driving level 104, does not reach the level of the ideal display response 106 before the pixel is driven to a second driving level, such as lower driving level 102. As shown, a pixel is driven at the upper driving level 104 during a first frame and at the lower driving level 102 during a second frame. The actual display response, such as the temporally uncompensated display response 108, of the pixel when driven at the lower driving level 102 never reaches the level of the ideal level 106, as represented by the ideal display response 106. Accordingly, the difference between the actual display response and the ideal display response will grow as the pattern is repeated.

Figure 1C:
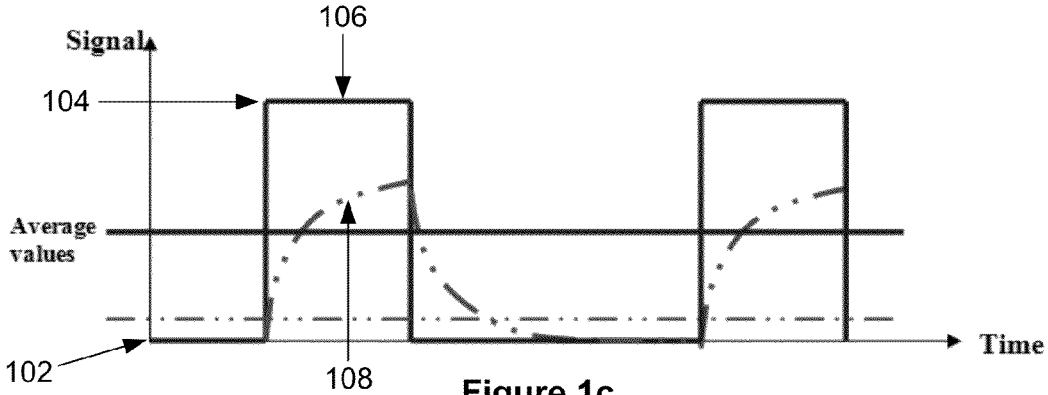
Figure 3A:
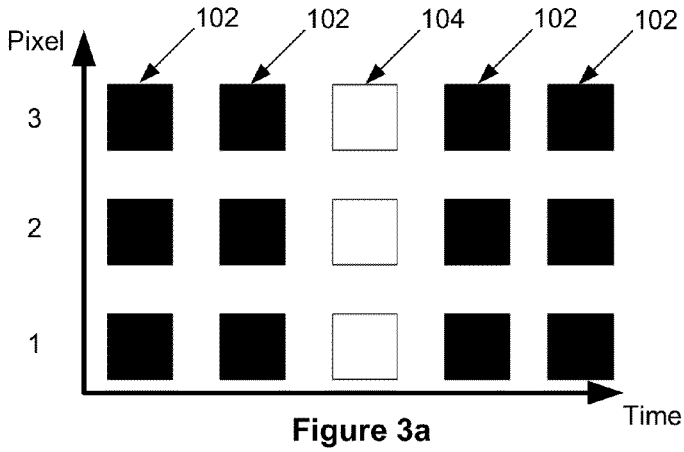
FIGS. 3*a-b* illustrate exemplary in phase test patterns corresponding to FIG. 1*c;*
Figure 3B:
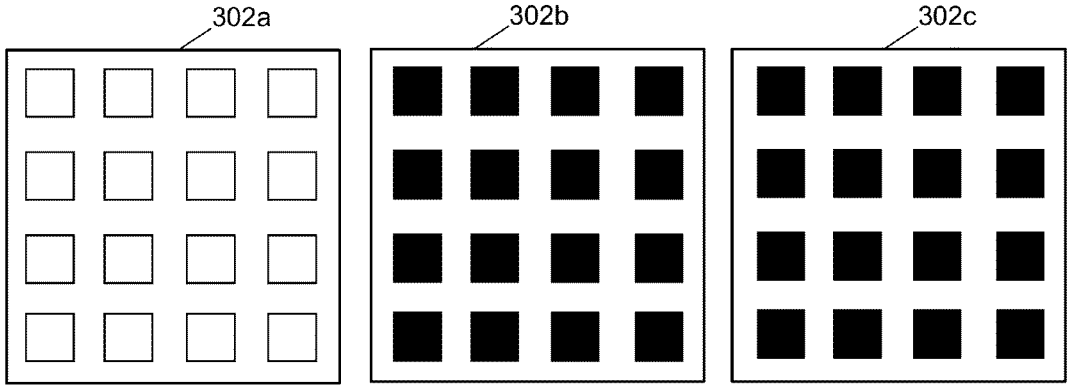

Turning next to FIGS. 1*c* and 3*a-b*, an aspect of the invention in which pixels are driven at a driving level for multiple consecutive frames is illustrated. FIG. 1*c* is a temporal response graph of a display alternating between driving a pixel at a lower driving level 102 for consecutive frames and at an upper driving level 104 for a single frame. FIG. 3*a* illustrates a subset of pixels driven as shown in FIG. 1*c*, and FIG. 3*b* illustrates pixels in a portion of a test region of exemplary consecutive in phase test patterns of pixels driven as shown in FIG. 1*c*. The white pixels represent pixels driven at a higher driving level, such as upper driving level 104 and the black pixels represent pixels driven at a lower driving level, such as lower driving level 102. The lower driving level 102 may be any driving level lower than the upper driving level 104. According to one embodiment, the lower driving level 102 is greater than the minimum display luminance and the upper driving level 104 is less than the maximum display luminance. For example, the lower driving level 102 may be 25% of the maximum display driving level and the upper driving level 104 may be 75% of the maximum display driving level. It will be understood by those of skill in the art that other levels may be used.

It also will be understood by those of ordinary skill in the art that the pixels of a display may be represented by spatial coordinates, rather than as a sequence in time. Accordingly, the Time axis of FIG. 1*c* could be replaced by a spatial coordinate axis so that FIG. 1*c* would show the spatial distribution of pixels at any given moment.

To evaluate temporal compensation for a pixel, it may be desirable to ensure that the effects of temporal inertia do not influence the temporal compensation evaluation. Therefore, according to an aspect of the invention, a pixel is driven at either the lower driving level 102 or the upper driving level 104 for consecutive frames sufficient to ensure that the uncompensated and compensated display responses, such the uncompensated display response 108 and the compensated display response 110, reach the ideal display response 106. If evaluating rise time of the compensated and/or uncompensated display response, the pixel may be driven at the lower driving level 102 for consecutive frames to ensure that the compensated and/or uncompensated display response matches, or falls within an acceptable range with respect to, the ideal display response at the lower driving level 102, as shown in FIG. 1*c*.

Likewise, if evaluating fall time of the compensated and/or uncompensated display response, the pixel may be driven at the upper driving level 104 for consecutive frames to ensure that the compensated and/or uncompensated display response matches, or falls within an acceptable range with respect to, the ideal display response at the upper driving level 104.

Thus, as shown in FIGS. 1*c* and 3*a-b* there may be displayed a first pattern 302*a* wherein pixels are driven at different driving levels L1 or L2. As shown in FIG. 3*b*, all of the pixels are driven at the upper driving level 104 in the first pattern 302*a*, and then at the lower driving level 102 for each of the second pattern 302*b* and third pattern 302*c*. The second pattern 302*b* and third pattern 302*c* may be the same, such as when all of the pixels of the first pattern 302*a* are driven at driving level L1, as shown. It will be understood by those of ordinary skill in the art that the patterns 302*a-c* may represent only a portion of the displayed image. For example, the patterns 302*a-c* may represent a test region of a display, or a portion or portions of a test region of a display.

As shown, driving level L1 may represent, for example, the output of the display when driven at upper driving level 104 and driving level L2 may represent, for example, the output of the display when driven at lower driving level 102. Each of the patterns 302*a-c* represents the same pixels. Also as shown, all of the pixels of the first pattern 302*a* are driven at driving level L1 (e.g., the upper driving level 104), and all of the pixels of the second pattern 302*b* and the third pattern 302*c* are driven at level L2 (e.g., the lower driving level 102). Thus, each pixel driven at driving level L1 in the first pattern 302*a* is subsequently driven at driving level L2 in the second pattern 302*b* and in the third pattern 302*c*. Accordingly, each pixel that is driven at driving level L1 is subsequently driven at driving level L2 for the next two patterns, 302*b* and 302*c*. Thus, the second pattern 302*b* and the third pattern 302*c* are the same pattern, which is different than the first pattern 302*a*.

Those of ordinary skill in the art will recognize that, depending on the characteristics of the display and the frequency settings, it may be desirable to continue to drive such pixels at driving level L2 for additional patterns to allow additional time for the compensated and/or uncompensated display response to match or more closely approximate the ideal display response. Thus, accordingly to an aspect of the invention, the pixels that are driven at driving level L1 in one of the first pattern, the second pattern, or the third pattern may be subsequently driven at driving level L2 for the next "n" number of patterns, where n is greater than or equal to 2. For example, all of the pixels driven at the upper driving level 104 in any pattern (e.g., the first pattern, the second pattern, the third pattern, or any additional pattern) may be driven at the lower driving level 102 for the next three or more patterns.

The number "n" may be selected so that the compensated and/or uncompensated display response matches, or falls within an acceptable range with respect to, the ideal display response when driven at driving level L2. Also, the number "n" may be selected such that the inverse of the refresh rate multiplied by the number "n" is a time that is greater than or equal to the rise time (or fall time) of the display to transition between driving level 1 and driving level 2.

It will be understood by one of ordinary skill in the art that it may be desirable to define driving level L1 as having a higher luminance than driving level L2 in order to evaluate rise time. For example, FIGS. 1*c* and 3*a-b* may be suitable for evaluating rise time where driving level L1 is upper driving level 104 and driving level L2 is lower driving level 102. It will also be understood by one of ordinary skill in the art that it may be desirable to define driving level L2 as having a higher luminance than driving level L1 in order to evaluate fall time. Accordingly, the patterns of the Figures herein may be reversed to evaluate fall time. In other words, driving level L1 may be the lower driving level 102 and driving level L2 may be the upper driving level 104.

One result of driving pixels at a selected level for multiple patterns (e.g., for multiple frames) is that the average luminance is lower than the average luminance achieved by using the test pattern illustrated in FIGS. 1*a-b* and 2. Another result is that the "effective" evaluation frequency is lower than the actual display frequency. For example, if the display frequency is 60 Hz and if the system used the patterns shown in FIGS. 1*c* and 3*a-b*, the evaluation period would extend to three frames. Accordingly, the "effective" evaluation frequency would be 20 Hz (the frequency divided by the number of evaluation periods). For a display having a frequency of 50 Hz, the "effective" frequency would be approximately 16.7 Hz. According to one embodiment, the refresh rate of the display divided by (n+1) number of patterns is less than 20 Hz. According to one embodiment, the refresh rate of the display divided by (n+1) number of patterns is greater than 16 Hz.

At such low "effective" evaluation frequencies, however, a user may be able to perceive a visible beat resulting from driving the pixels at driving levels L1 and L2. In addition, a user may be able to perceive the symmetry of the in phase patterns 302*a-c*. The patterns can be made less perceptible to a user by breaking the spatial symmetry of the patterns so that individual pixels are out of phase with one another. In addition, dithering techniques, such as those disclosed in U.S. Patent App. 20100259553 to Van Belle may be used.

Figure 4A:
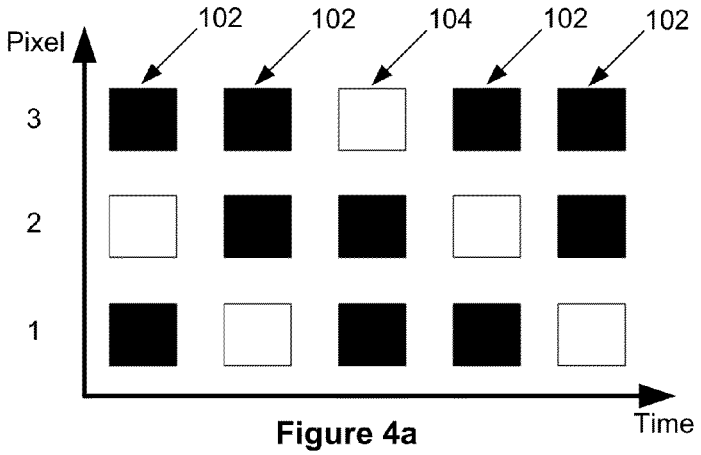
FIGS. 4*a-b* illustrate exemplary out of phase test patterns corresponding to FIG. 1*c;*
Figure 4B:
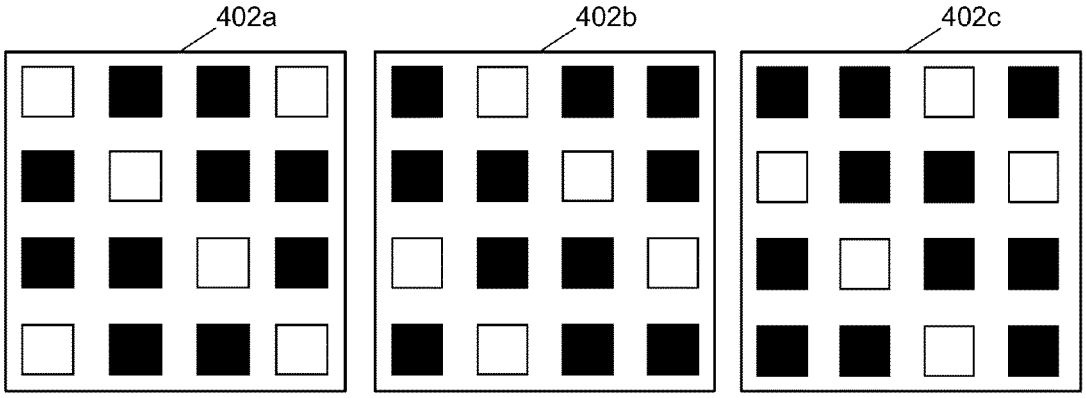

Turning next to FIGS. 4*a-b*, FIG. 4*a* illustrates an alternative pattern that may be substituted for that of FIG. 3*a*, and FIG. 4*b* illustrates portions of exemplary consecutive out phase test patterns that may be substituted for those of FIG. 3*b*. Like in FIGS. 3*a-b*, FIGS. 4*a-b* illustrate that pixels driven at driving level L1 in one of the first pattern 402*a*, the second pattern 402*b*, or the third pattern 402*c* may be subsequently driven at driving level L2 for the next "n" number of patterns, where n is greater than or equal to 2.

Unlike FIGS. 3*a-b*, however, FIGS. 4*a-b* illustrate a pattern where pixels are out of phase with adjacent pixels in each of the patterns 402*a-c*. For example, in each of the patterns 402*a-c*, each pixel driven at driving level L1 (indicated by 104) may be immediately adjacent at least one pixel driven at driving level L2 (indicated by 102). In addition, each pixel driven at driving level L1 may be immediately adjacent at least 6 pixels driven at level L2 (excluding, of course, pixels adjacent the edge of the display). In addition, as shown in FIGS. 4*a-b*, each of the patterns 402*a-c* may have at least approximately twice as many pixels driven at driving level L2 as are driven at driving level L1. The out of phase configuration may decrease a viewer's perception of patterns. In addition, as discussed above, dithering techniques may also be used.

Figure 5:
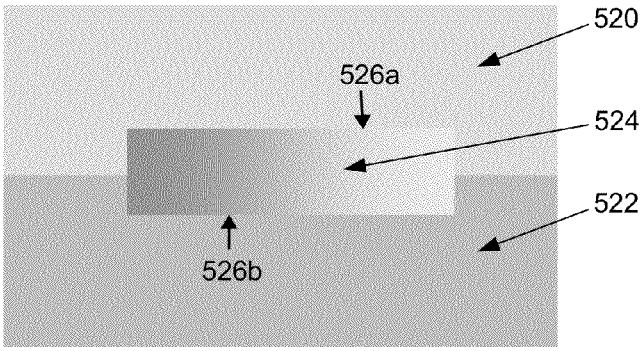
FIGS. 5-7 illustrate different mechanisms for displaying the test patterns.
Figure 6:
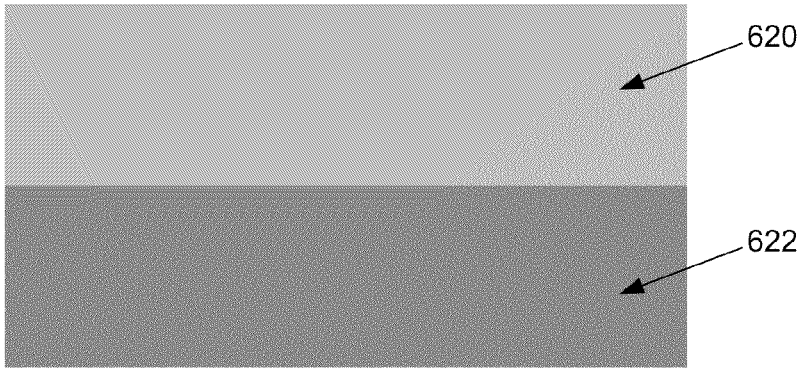
Figure 7:
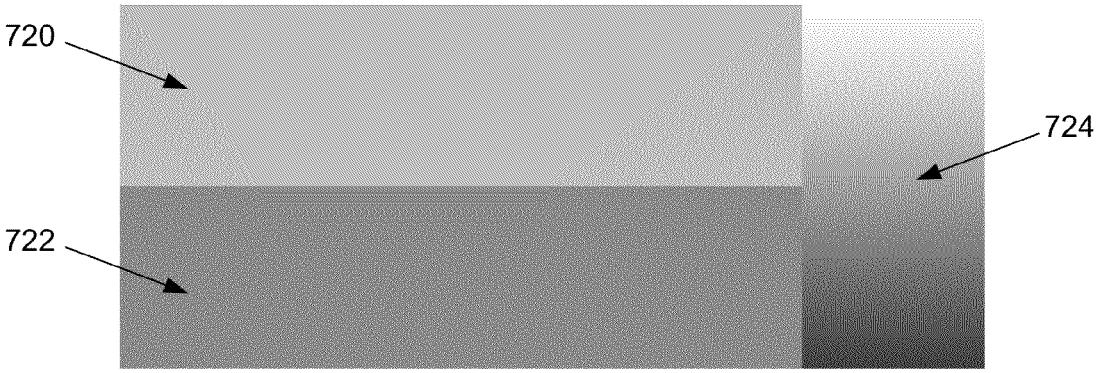

Turning next to FIGS. 5-7, different mechanisms for displaying the patterns to evaluate temporal compensation are provided. According to one aspect of the invention, a portion of the pixels of the patterns (e.g., patterns 302*a-c* and 402*a-c*) may be subjected to temporal response compensation while another portion of the patterns are not subjected to temporal response compensation. Accordingly, the output of the compensated pixels may be compared to the output of the uncompensated pixels. FIGS. 5-7 illustrate exemplary arrangements for comparing compensated and uncompensated pixels.

For example, temporal response compensation may be performed for a compensation portion of the pixels of a test region (e.g., a portion of the pixels of the patterns 302*a-c* or 402*a-c*) while no temporal response compensation is performed for a noncompensation portion of the pixels of the test region such that a comparison can be made between the compensation portion of the pixels and the noncompensation portion of the pixels. According to one aspect of the invention, temporal response compensation may be performed simultaneously with the display of the first pattern 302*a*, 402*a*, the second pattern 302*b*, 402*b* and the third pattern 302*c*, 402*c*.

If the difference between driving level L1 and driving level L2 is large enough, and if temporal compensation is effective, a viewer should be able to perceive a difference in color (e.g., levels of gray) between the compensated portion 520, 620 720 and the uncompensated portion 522, 622, 722, as shown in FIGS. 5-7. In addition, as shown in FIGS. 5 and 7, a gradient feature 524, 724 may be displayed. The gradient feature 524, 724 may have a plurality of regions adjacent the test region for each of the patterns 302*a-c* and 402*a-c*. In this manner, the display of the gradient feature 524, 724 may be constant while the pixels in the patterns 302*a-c*, 402*a-c* are driven at alternating driving levels L1 and L2. In addition, in order to assist the viewer in quantifying the difference between the compensated portion 520, 620, 720 and the uncompensated portion 522, 622, 722, the gradient feature 524, 724 may include pixels driven at intermediate levels between driving level L1 and driving level L2. Also, as shown in FIG. 5, the system may permit the user to mark where the output of the pixels in compensated portion 520 and the pixels in the uncompensated portion 522 match the gradient feature 524, 724, as indicated by arrows 526.

Figure 8:
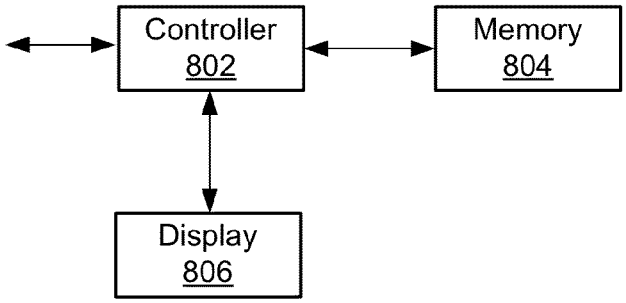
FIG. 8 illustrates a system for evaluating temporal response of a display.

Turning next to FIG. 8, provided is a block diagram of a display system according to the invention. In its simplest form, the system includes a controller 802, memory 804 and a display 806. Although the controller 802 and/or memory 804 is in communication with the display 806, the controller 802 and/or memory 804 may or may not be part of the physical display device (e.g., monitor) that includes the display 806.

Stored in memory 804 (i.e., a non-transitory computer readable medium) may be computer readable code, wherein execution of program instructions generated by the computer readable code by the controller 802 causes the controller 802 to carry out the steps of: causing the display to display a first pattern 302*a*, 402*a* wherein pixels of a test region of the display are driven at driving levels L1 or L2; causing the display to display a second pattern 302*b*, 402*b* wherein the pixels of the test region are driven at driving levels L1 or L2, and wherein the second pattern 302*b*, 402*b* is different than the first pattern 302*a*, 402*a*; and causing the display to display a third pattern 302*c*, 402*c* wherein the pixels of the test region are driven at driving levels L1 or L2, and wherein the third pattern 302*c*, 402*c* is different than the first pattern 302*a*, 402*a*. The pixels of the test region that are driven at driving level L1 in one of the patterns 302*a-c*, 402*a-c* may be subsequently driven at driving level L2 for the next n number of patterns, where n is greater than or equal to 2. In addition, the controller 802 may cause temporal response compensation to be performed for a compensation portion 520, 620, 720 of the pixels of the test region and to not be performed for a noncompensation portion 522, 622, 722 of the pixels of the test region such that a comparison can be made between the compensation portion 520, 620, 720 of the pixels and the noncompensation portion 522, 622, 722 of the pixels.

The controller 802 may configured to perform all of the functionality described herein. In doing so, the controller may access and store information, such as LUTs or data used for or derived from algorithms, in memory 804.

It will be understood by those of skill in the art that the controller 802 may be any type of control circuit implemented as one or combinations of the following: as a hard-wired circuit; programmable circuit, integrated circuit, memory and i/o circuits, an application specific integrated circuit, application-specific standard product, microcontroller, complex programmable logic device, field programmable gate arrays, other programmable circuits, or the like. The memory 804 may be any type of non-transitory computer readable medium as will be understood by those of skill in the art. Additionally, the display 806 may be any type of display technology (e.g., CRT, LED, OLED, EL, CCFL, etc.).

In addition the functions and methodology described herein may be implemented in part or in whole as a firmware program loaded into non-volatile storage (for example, an array of storage elements such as flash RAM or ferroelectric memory) or a software program loaded from or into a data storage medium (for example, an array of storage elements such as a semiconductor or ferroelectric memory, or a magnetic or optical medium such as a disk) as machine-readable code, such code being instructions executable by an array of logic elements such as a microprocessor, embedded microcontroller, or other digital signal processing unit. Embodiments also include computer program products for executing any of the methods disclosed herein, and transmission of such a product over a communications network (e.g. a local area network, a wide area network, or the Internet). Thus, the present invention is not intended to be limited to the embodiments shown above but rather is to be accorded the widest scope consistent with the principles and novel features disclosed in any fashion herein.

As used herein, the term "display" is intended to refer to any type of display. The term "display" should not be limited to any particular type of display, and includes such things as cathode ray tube displays, transmissive displays, emissive displays, projectors, and any other type of apparatus or device that is capable of displaying an image for viewing.

As used herein, the term "test pattern" is intended to refer to any pattern displayed as part of or as an entire frame of a display.

As used herein, "non-transitory computer readable medium" includes any computer-readable medium except for transitory, propagating signals.

As used herein, "program instructions" includes any instructions adapted to directly or indirectly cause a device, such as a controller or other device, to execute a command.

Although the invention has been shown and described with respect to a certain preferred embodiment or embodiments, it is obvious that equivalent alterations and modifications will occur to others skilled in the art upon the reading and understanding of this specification and the drawings. In particular, in regard to the various functions performed by the above described elements (components, assemblies, devices, compositions, etc.), the terms used to describe such elements are intended to correspond, unless otherwise indicated, to any element which performs the specified function of the described element (i.e., that is functionally equivalent). In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A method for evaluating temporal response of a display comprising:

displaying a first pattern wherein pixels of a test region of the display are driven at driving levels L1 or L2;

displaying a second pattern wherein the pixels of the test region are driven at driving levels L1 or L2, and wherein the second pattern is different than the first pattern; and displaying a third pattern wherein the pixels of the test region are driven at driving levels L1 or L2, and wherein the third pattern is different than the first pattern;

wherein the pixels of the test region that are driven at driving level L1 in one of the first pattern, the second pattern, or the third pattern are subsequently driven at driving level L2 for the next n number of patterns, where n is greater than or equal to 2; and wherein temporal response compensation is performed for a compensation portion of the pixels of the test region and no temporal response compensation is performed for a noncompensation portion of the pixels of the test region such that a comparison can be made between the compensation portion of the pixels and the noncompensation portion of the pixels.

2. The method of claim 1 wherein the second pattern and the third pattern are the same.

3. The method of claim 1 wherein for each of the first pattern, the second pattern and the third pattern, at least approximately twice as many of the pixels are driven at L2 as are driven at L1.

4. The method of claim 1 wherein rise time is evaluated by defining driving level L1 to result in a higher luminance than driving level L2.

5. The method of claim 1 wherein fall time is evaluated by defining driving level L2 to result in a higher luminance than driving level L1.

6. The method of claim 1 wherein temporal response compensation is performed simultaneously with the display of the first pattern, the second pattern and the third pattern.

7. The method of claim 1 further comprising displaying a gradient feature having a plurality of regions adjacent the test region for each of the first pattern, the second pattern and the third pattern.

8. The method of claim 7 wherein at least some of the regions of the gradient feature comprise pixels driven at intermediate driving levels between driving level L1 and driving level L2.

9. The method of claim 1 wherein for each of the first pattern, the second pattern and the third pattern, each pixel driven at driving level L1 is immediately adjacent at least one pixel driven at driving level L2.

10. The method of claim 9 wherein for each of the first pattern, the second pattern and the third pattern, each pixel driven at driving level L1 and not adjacent the edge of the display is immediately adjacent at least six pixels driven at driving level L2.

11. The method of claim 1 wherein the refresh rate of the display divided by (n number of patterns plus 1) is greater than or equal to about 16 Hz.

12. The method of claim 1 wherein the refresh rate of the display divided by (n number of patterns plus 1) is less than 20 Hz.

13. A system for evaluating temporal response of a display comprising:

computer readable code on a non-transitory computer readable medium, wherein execution of program instructions generated by the computer readable code by at least one controller communicably coupled to the display causes the at least one controller to carry out the steps of:

causing the display to display a first pattern wherein pixels of a test region of the display are driven at driving levels L1 or L2;

causing the display to display a second pattern wherein the pixels of the test region are driven at driving levels L1 or L2, wherein the second pattern is different than the first pattern; and causing the display to display a third pattern wherein the pixels of the test region are driven at driving levels L1 or L2, wherein the third pattern is different than the first pattern;

wherein the pixels of the test region that are driven at driving level L1 in one of the first pattern, the second pattern, or the third pattern are subsequently driven at driving level L2 for the next n number of patterns, where n is greater than or equal to 2; and wherein temporal response compensation is performed for a compensation portion of the pixels of the test region and no temporal response compensation is performed for a noncompensation portion of the pixels of the test region such that a comparison can be made between the compensation portion of the pixels and the noncompensation portion of the pixels.

14. The system of claim 13 wherein the second pattern and the third pattern are the same.

15. The system of claim 13 wherein for each of the first pattern, the second pattern and the third pattern, at least approximately twice as many of the pixels are driven at L2 as are driven at L1.

16. The system of claim 13 wherein rise time is evaluated by defining driving level L1 to result in a higher luminance than driving level L2.

17. The system of claim 13 wherein fall time is evaluated by defining driving level L2 to result in a higher luminance than driving level L1.

18. The system of claim 13 wherein temporal response compensation is performed simultaneously with the display of the first pattern, the second pattern and the third pattern.

19. The system of claim 13 wherein the at least one controller is further caused to display a gradient feature having a plurality of regions adjacent the test region for each of the first pattern, the second pattern and the third pattern.

20. The method of claim 18 wherein at least some of the regions of the gradient feature comprise pixels driven at intermediate driving levels between driving level L1 and driving level L2.

21. The system of claim 13 wherein for each of the first pattern, the second pattern and the third pattern, each pixel driven at driving level L1 is immediately adjacent at least one pixel driven at driving level L2.

22. The system of claim 21 wherein for each of the first pattern, the second pattern and the third pattern, each pixel driven at driving level L1 and not adjacent the edge of the display is immediately adjacent at least six pixels driven at driving level L2.

23. The system of claim 13 wherein the refresh rate of the display divided by (n number of patterns plus 1) is greater than or equal to about 16 Hz.

24. The system of claim 13 wherein the refresh rate of the display divided by (n number of patterns plus 1) is less than 20 Hz.

25. A display system comprising:

a display;

a controller communicably coupled to the display; and non-transitory memory communicably coupled to the controller, the memory comprising computer readable code, wherein execution of program instructions generated by the computer readable code by the controller causes the at least one controller to carry out the steps of:

causing the display to display a first pattern wherein pixels of a test region of the display are driven at driving levels L1 or L2;

causing the display to display a second pattern wherein the pixels of the test region are driven at driving levels L1 or L2, wherein the second pattern is different than the first pattern; and causing the display to display a third pattern wherein the pixels of the test region are driven at driving levels L1 or L2, wherein the third pattern is different than the first pattern;

wherein the pixels of the test region that are driven at driving level L1 in one of the first pattern, the second pattern, or the third pattern are subsequently driven at driving level L2 for the next n number of patterns, where n is greater than or equal to 2; and wherein temporal response compensation is performed for a compensation portion of the pixels of the test region and no temporal response compensation is performed for a noncompensation portion of the pixels of the test region such that a comparison can be made between the compensation portion of the pixels and the noncompensation portion of the pixels.

* * * * *